US005087047A

United States Patent [19]

McConnell

[11] Patent Number: 5,087,047

[45] Date of Patent: Feb. 11, 1992

[54] GOLF TRAINING METHOD AND APPARATUS

[76] Inventor: John P. McConnell, 2283 Hogback Rd., Sunbury, Ohio 43074

[21] Appl. No.: 668,052

[22] Filed: Mar. 12, 1991

[51] Int. Cl.[5] ..... A63B 69/36; G08B 13/14

[52] U.S. Cl. ..... 273/183 B; 250/215; 250/221; 273/186 R; 273/190 R

[58] Field of Search ..... 273/183 B, 183 R, 183 D, 273/186 R, 186 D, 190 R, 188 R; 250/221, 222.1, 215

[56] References Cited

U.S. PATENT DOCUMENTS

| | | | |
|---|---|---|---|
| 1,636,753 | 7/1927 | Olcott | 273/190 R |
| 2,737,432 | 3/1956 | Jenks | 273/190 R X |
| 3,243,186 | 3/1966 | Johnson | 273/183 B |
| 3,293,186 | 12/1966 | Chu et al. | 252/79.3 |
| 3,326,558 | 6/1967 | Eaton, Jr. | 273/183 B |
| 3,350,102 | 10/1967 | Tiernan | 273/190 R |
| 3,415,523 | 12/1968 | Boldt | 273/186 R |
| 3,770,280 | 11/1973 | Straus | 273/183 B |
| 3,776,555 | 12/1973 | Hagaman | 273/186 R |
| 3,895,366 | 7/1975 | Morris | 273/186 R X |
| 4,302,014 | 11/1981 | Shull | 273/183 B |
| 4,303,244 | 12/1981 | Uppvall | 273/183 B |
| 4,477,079 | 10/1984 | White | 273/186 R |
| 4,502,035 | 2/1985 | Obenauf et al. | 273/183 B X |
| 4,513,972 | 4/1985 | Empie | 273/190 R |
| 4,869,509 | 9/1989 | Lee | 273/183 B |
| 4,903,968 | 2/1990 | Hargrave | 273/186 A |
| 4,971,325 | 11/1990 | Lipps | 273/183 B |
| 5,023,597 | 6/1991 | Salisbury | 250/221 |

*Primary Examiner*—George J. Marlo

*Attorney, Agent, or Firm*—Vorys, Sater, Seymour & Pease

[57] ABSTRACT

A golf training system for detecting unwanted golfer's head displacement during a golf swing includes a support assembly having a vertically adjustable assembly;

a first motion detecting device being operable for detecting golfer's head displacement and for generating a signal indicative of such displacement, said first detecting device being an electromagnetic motion detecting means;

a second motion detecting device being operable for detecting a golf club head travelling in a preselected zone which zone is inclusive of where a golf ball would be during a swing and for generating a signal indicative of a golf club travelling in said zone and impacting a ball; and a display unit responsive to said signals of said first and second motion detecting devices for indicating unwanted golfer's head displacement prior to a golf club head travelling in said zone and for indicating when a golf club head travels in said zone prior to golfer's head displacement for indicating unwanted golfer's head displacement.

16 Claims, 3 Drawing Sheets

GOLF TRAINING METHOD AND APPARATUS

The present invention relates generally to a golf training method and system and, in particular, to a method and system for use in teaching a golfer proper head orientation and motion for successful golf club swings.

Numerous devices have been proposed for teaching golfers the proper physical techniques needed for successful golf. These teaching devices include a wide range of approaches for controlling body position and movement relative to performing golfing activities including putting to swinging golf clubs. As is well known, one of the more difficult techniques to master in golf is a proper club swing. Many factors are involved and one important component in this regard is proper orientation and controlled movement of the head. More specifically, maintaining a golfer's head relatively immobile during a swing is of critical importance. Towards the end of achieving this, some prior art approaches utilize head restraints which are adapted to physically constrain head movement during swinging and have a tendency to make natural head movement during the swing follow-through difficult. Representative examples of this type of training aid are described in U.S. Pat. Nos.: 2,737,432; 3,293,186; 3,415,523; and 3,770,280. U.S. Pat. No. 4,302,014, for instance, discloses an approach for constraining head movement, but which allows limited head movement. In this regard, use is made of a flexible band having Velcro TM connectors. In such an approach, if a golfing trainee moves his head in an undesired fashion, the head slips from the band to indicate undesired head displacement.

Other approaches for training a golfer to swing properly do not physically restrain a golfer's head, but rather include motion sensors or detectors for detecting undesired head movement. In this latter regard, U.S. Pat. No. 4,869,509 describes a self-contained battery powered head motion sensor installed in a golfer's cap, which sensor is activated by undesired head movement. U.S. Pat. No. 4,502,035 relates to a motion sensor connected to a golfer's hat for indicating head movement. In this connection, the sensor continuously outputs an electric signal proportional to the degree of sensed head displacement.

Still another type of training device combines the inputs of sensors for both head motion and golf club movement. In this regard, U.S. Pat. No. 4,971,325 describes an apparatus for practicing golf swings utilizing a beam from a user's cap coordinated with a photoreceptor device located on the ground and a simulated golf club which emits a beam of light that cooperates with a sensing and recording device on the ground. As a result, head movement is related to club movement to provide real-time feedback to a trainee as to the proper correlation between the golfer's head and the club during a swing. Such a training apparatus is somewhat limited, however, for example, it requires utilization of a simulated golf club rather than a real club. Another approach is described in U.S. Pat. No. 3,895,366 wherein a training device is disclosed as having motion sensors which correlate undesired head movement with a golf swing, such that a successful swing is indicated if the head remains immobile while the club strikes a golf ball.

Despite the various approaches to date there is nevertheless a continuing desire to improve upon them.

SUMMARY OF THE INVENTION

It is an object of the present invention to provide for an improved method and system for training a golfer to maintain his head in a desired orientation while swinging a golf club. It is another object of the invention to allow a golfer as much natural head movement as possible, but train the golfer to hold his head stationary during a crucial segment of the golf swing.

According to one aspect of the present invention there is provided a golf training system for detecting unwanted head displacement during a golf swing. Included in the system is a support assembly having a vertically adjustable assembly associated therewith. Provision is made for a first motion detecting means being operable for detecting golfer's head displacement and for generating a signal indicative of such displacement. In this embodiment, the first detecting means is an infrared detecting means. A second motion detecting means is provided which is operable for detecting a golf club head passing a preselected zone. The zone is inclusive of where a golf ball would normally be during a swing. The second motion detecting means is operable for generating a signal indicative of a golf club travelling through the zone. Provision is made for means responsive to the signals of the first and second motion detecting means for indicating unwanted golfer's head displacement prior to a golf club head travelling in the zone.

In an illustrated embodiment, the indicating means is operable for indicating that a golf head travels through the zone prior to the first motion detecting means detecting head movement, thereby indicating proper head position during swinging. The indicating means allows a golfer's head to move during backswing and allows head follow-through following golf club impact with the ball without activating an alarm.

In another illustrated embodiment, the first infrared motion detecting means includes a first photoresponsive means coupled to the vertically adjustable means. This enables vertical adjustment of the photoresponsive means to the height of a golfer. The first motion detecting means also includes infrared transmitting means positionable on an upright support assembly which is spaced laterally from the first photoresponsive means and which is operable for transmitting an infrared beam to the first photoresponsive means. Undesired movement of a golfer's head interrupts the beam, thereby creating a signal indicative of such undesired movement.

In another illustrated embodiment, the second motion detecting means includes a second infrared photoresponsive means mounted on the upright support assembly at a location so as to monitor club head movement travelling in a ball striking zone. The second infrared motion detecting means includes a second infrared transmitting means spaced laterally from the second photoresponsive means for transmitting an infrared beam to the second photoresponsive means. The second photoresponsive means is operable for generating a signal indicative of a club head travelling in the ball striking zone located between the second infrared transmitting means and the second infrared photo-responsive means.

In another illustrated embodiment, the second photoresponsive means is mounted on the upright support assembly and is adjustably positioned in a horizontal manner relative to the upright assembly to thereby allow repositioning of a golf ball.

In an illustrated embodiment, the motion detecting means includes an infrared transmitter and receiver on a support assembly which is remote from the upright assembly and a reflecting assembly on the upright support assembly which is aligned with the transmitter and receiver.

In another illustrated embodiment, the golf training system includes a head restraining means mounted on the vertically adjustable means and which is adapted for receiving and positively positioning a golfer's head in a preselected orientation.

In another illustrated embodiment, provision is made for a golfer's head restraining means for guiding a golfer's head into a proper orientation for a golf swing and for permitting limited head displacement. The head restraining means is mounted on the vertically adjusted assembly and a horizontally adjustable assembly, thereby allowing individual placement of the head restraining means.

In another illustrated embodiment, the head restraining means includes a helmet assembly adapted to accommodate a golfer's head and which is adapted for guiding the head into the desired orientation. The helmet assembly includes a portion movable in response to head displacement and a motion detecting switch that is operable for indicating movement thereof in response to engagement by a golfer's head.

In another illustrated embodiment, the head restraining means includes a movable portion operatively and mechanically connected to a motion detecting switch means. The movable portion upon movement activates the switch which is indicative of head movement.

In still another illustrated embodiment, the support assembly is portable and collapsible for ease of assembly and transportation.

Among the other objects and features of the present invention are the provisions of an improved method and apparatus for golf training; the provisions of an improved method and golf training apparatus which guides and orients a golfer's head for proper club swing, but which allows a golfer's head natural movement; the provision of an improved method and apparatus wherein there is an indication of a successful golf swing occurring without undesired head motion by utilizing infrared beams; the provisions of an improved method and apparatus of the last noted type for indicating undesired head movement prior to a successful swing; the provisions of such an apparatus which includes a helmet for positioning the golfer's head but having a movable portion which tilts in response to engagement by a golfer's head so as to allow a golfer's head to naturally follow-through during a swing; the provision of an improved method and apparatus of the foregoing type in which the movable portion of the helmet is counterweighted to return to its original position following natural head movement; and, the provisions of an improved method and training apparatus which is portable and collapsible.

DETAILED DESCRIPTION

Figure 1:
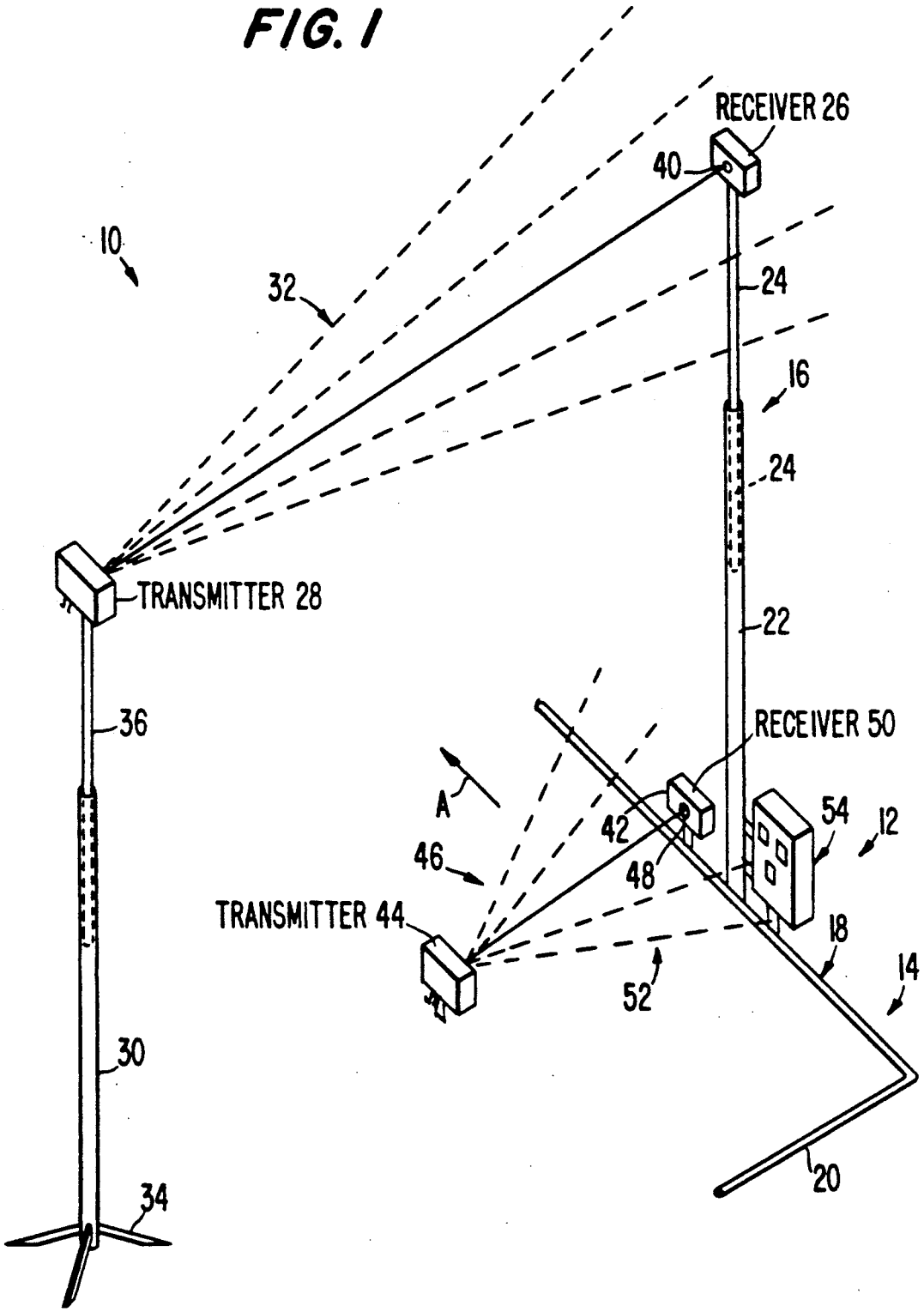
FIG. 1 is a perspective view of a preferred embodiment of the present invention.

Reference is made to FIG. 1 for illustrating one preferred embodiment of a golf training apparatus made according to the present invention which is designated generally by reference numeral 10. The golf training apparatus 10 is adapted to be portable and collapsible so as to facilitate ease of assembly and disassembly as well as transportability to various locations. The training apparatus 10 includes an upstanding support assembly 12 that includes a horizontal base assembly 14 and a vertically adjustable assembly 16. The base assembly 14 has a generally L-shaped configuration having an elongated portion 18 extending in a direction, indicated by arrow A, generally parallel to a golf swing and a rearward stabilizing arm 20 which is located to the right of a golfer and which provides stabilizing support. It will be understood that a golfer when using this device faces the vertically adjustable assembly 16. Provision is made for a vertically oriented tubular support post 22 which telescopically receives a vertically positionable rod 24. A set screw (not shown) or the like releasably secures the rod 24 in preselected vertical positions by manipulation of the set screw. In this embodiment, the upstanding support assembly 12 is, preferably, made of a lightweight plastic material, but, of course, it could be made of other suitable materials such as lightweight stainless steel and the like for portability and weather resistance.

Attached to the top of the adjustable rod 24 is an infrared photoresponsive motion detecting device or receiver 26. Of course, the vertical position of the photoresponsive receiver 26 is regulated to the position of a head of a golfer or trainee so as to accommodate for the height of different golfers.

Spaced in juxtaposed relationship to the receiver 26 is an infrared transmitter 28 which is supported by a vertically extending tubular post 30 connected to a tripod 34. Telescopically mounted in the tubular post 30 is a rod 36 which is vertically adjustably positioned in the post 30 by manipulation of an adjustable set screw (not shown) or the like. As a consequence, the transmitter 28 can be positioned to accommodate golfers of various heights. More specifically, the transmitter 28 is set to the height of the golfer's head position during swinging. The infrared transmitter 28 generates a wide infrared beam 32 which forms a zone and strikes a window 40 of the photoresponsive motion detector 26. Of course, the infrared beam 32 is aligned so as to be in a relationship as to detect head movement through the beam. It will be appreciated that movement of a golfer's head during a golf swing will interrupt the beam 32, and this causes the detector 26 to generate an interrupt signal indicative of such head movement. Both the infrared photoresponsive detector and transmitter 28 are commercially available and hence, detailed descriptions thereof need not be given since they do not, per se, form an aspect of this invention. Since the golf training apparatus 10 is intended to be portable, both the transmitter and photoresponsive detector 26 can be powered by portable DC power sources (not shown) with suitable on/off switches (not shown) operatively associated therewith.

While the present embodiment has disclosed the use of infrared sources of energy for purposes of detecting motion, it is within the principles of the present invention that other types of electromagnetic radiation, such as visible light and radio frequencies can be used or even acoustical energy can be used. Also, while this embodiment depicts a separated transmitter and receiver, it will be understood that the two can be combined into a single unit which would operate in conjunction with a reflector member.

Another aspect of this invention is the golf club motion detecting assembly which includes an infrared photoresponsive motion detector 42. The detector 42 is secured to and adjustably positionable along the length of support member 18. Such an adjustable connection can be affected by a spring clamp (not shown) or the like. In this fashion, the detector 42 can be adjustably positioned for the convenience of the user as well as accommodating different golf ball and tee locations. In this embodiment, an infrared beam transmitter device 44 is mounted on a suitable stake or the like, so that it can be positioned in the ground. Of course, the transmitter 44 can be connected to other devices for having it placed in a removable fashion at various locations on the ground. The transmitter 44 emits a wide infrared energy beam 46 which is detected by a window 48 of the photoresponsive motion detector 50. This infrared beam defines a zone 52 in which a golf ball is to be placed and impacted by the golf club. Accordingly, when a golf club intersects the beam and strikes the ball, a signal is generated which is indicative of the club motion. Although the detector 50 detects when the ball is struck, the transmitter and detector can be arranged to sense when the club travels through the zone 52 without the ball being present. The transmitter 44 is positioned, preferably, in front of the golfer's feet so that the detector 50 is responsive to club motion.

In this preferred embodiment, both the photoresponsive detectors and their respective transmitters are electrically connected to a display unit 54. The display unit 54 can be an electroluminescent type which includes a suitable switching circuit arrangement (not shown) for activating visual indicators (not shown) which indicate so-called successful and unsuccessful swings depending on the sequence of activation of the photoresponsive detectors 26 and 42. Specifically, if the photoresponsive detector 42 is activated by the interruption of a golf club prior to the detector 26 being activated by a golfer's head interrupting the beam, then the display unit 54 will activate a light to indicate a successful or good swing. Alternatively, if the golfer's head interrupts the infrared beam to the photoresponsive detector 26 prior the golf club intersecting the zone 52, then the display unit 54 will activate a light to indicate a faulty swing based on premature and thereby undesired head movement. Of course, the indicator indicating a good swing is suppressed. Audio signals can be provided instead of visual signals. By virtue of the foregoing, the golfer may move his head in a natural follow-through manner without such natural motion being physically restrained or interfered. Also, head movement during the backswing is tolerated without activating this alarm. Accordingly, the alarm will be activated by the golfer's head if the head interrupts the beam before golf ball impact. The foregoing approach is beneficial for the more experienced golfer who generally keeps the head immobile through golf ball impact.

Figure 2:
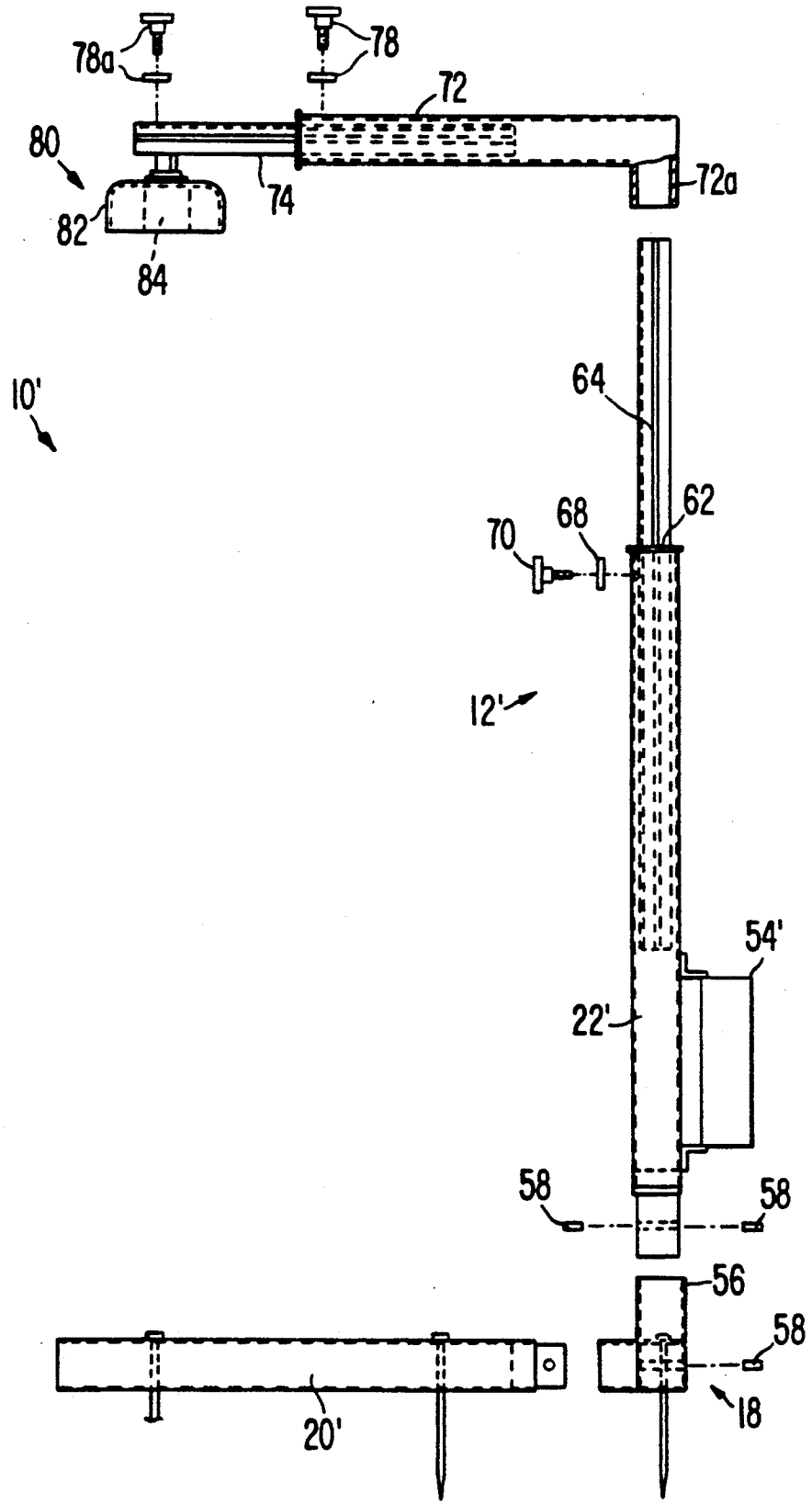
FIG. 2 is a side elevational view of another view of a preferred embodiment of the present invention.

Reference is made to another preferred embodiment of this invention. The same structure of this embodiment as with the previous embodiment will be represented by the same reference numeral with, however, the addition of a prime marking. As depicted in FIG. 2, the support assembly 12' includes a vertically extending tubular post 22' which has a reduced diameter end portion adapted to be snugly received within a corresponding tubular post support segment 56. A plurality of spring plungers 58 cooperate with aligned openings in the post 22' and the support segment 56. This construction facilitates a quick assembly and disassembly of the vertical post 22' to the base assembly 14'. An end cap 62 provides an opening for receiving a splined and vertically extensible and adjustable post 64. The adjustable post 64 is extensible and retractable within the hollow post support 22', whereby the former is adjustably vertically positionable to accommodate various heights of users. In this embodiment, a height adjusting means takes the form of a plastic nut 68 threadedly cooperating with an adjusting screw 70 for securing the post 64 in a desired vertical position.

A cantilevered tubular horizontal beam 72 has an end portion **72*a* which is press fit onto a suitable end of the post 64. A tubular horizontally adjustable post 74 is mounted for horizontal telescopic movement within the beam 72 and its horizontal position is adjusted by an adjusting nut and screw assembly 78. This allows for adjustment by golfers having different golf club lengths. Of course, other adjusting mechanisms can be provided for releasably adjusting the position of the post 74 relative to the beam 72. Although not shown, this invention contemplates structure that would allow the beam 72 to have a folding relationship to the vertical rod 64**.

Reference is now made to the base support assembly 14' which is depicted as including a generally elongated member 18' and arm portion 20', each having a pair of ground stakes attached to bottom portions thereof so as to secure the assembly 14' to the ground. As with the previous embodiment, the upstanding support assembly 12' and base assembly 14' are, preferably, comprised of a wide variety of lightweight and weather resistant materials.

This embodiment is intended for beginners or novice golfers who have difficulty maintaining their heads immobile during the crucial part of the swing (i.e. before the club contacts the ball).

Figure 3:
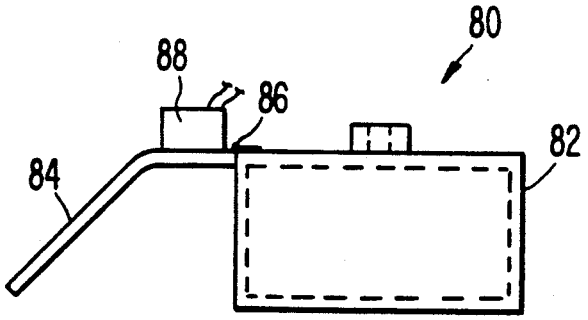
FIG. 3 is an enlarged view of a helmet assembly of the present invention.
Figure 4:
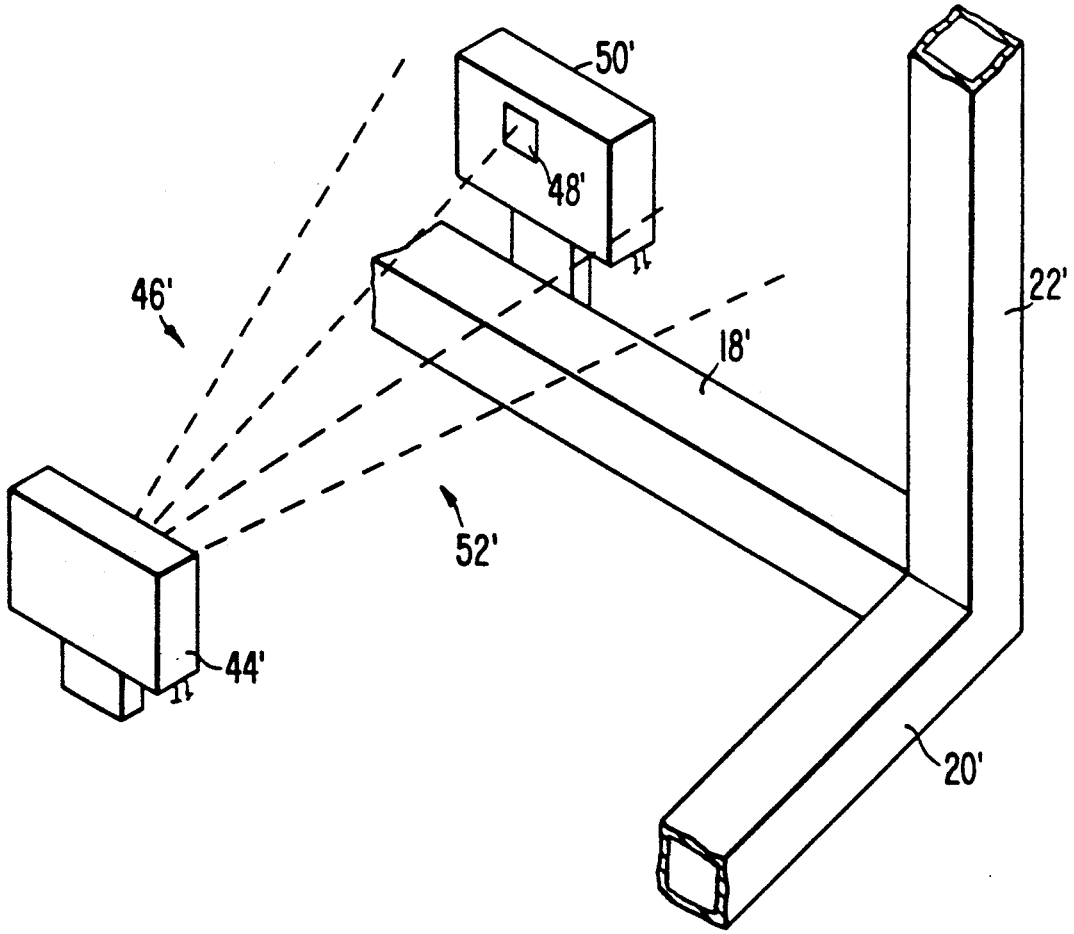
FIG. 4 is a perspective view of another aspect of the latter embodiment.

Towards this end, a helmet assembly 80 is attached to a distal end portion of the post 74 by any suitable structure including a screw and nut assembly **78*a*. In this particular embodiment, the helmet assembly 80 includes a stationery head guiding portion 82 which is sized, constructed and oriented to provide positive guidance for orienting a user's head into a desired position for a proper golf swing. Another portion of the helmet assembly 80 includes a tiltable plate portion 84 which is pivotally attached at 86 to the head guiding portion 82. The tiltable plate 84 is shaped, such as shown in FIG. 3, and is adapted to be engaged by the golfer's head upon displacement of the latter so as to activate motion detecting switch 88. In this manner, because of the guiding portion 82, benefit, especially for a beginner, is obtained due to its influence in guiding the golfer's head in a desired orientation. However, due to the tilting plate 84, there is the facility for allowing the user to move his head as during a natural head follow-through during a swing. The helmet assembly 80 an be made of a variety of devices and, in this particular embodiment, the guiding portion 82 and tiltable plate 84 are made of a suitable lightweight and weather resistant plastic material. The motion detecting switch 88 can include a mercury switch or the like which is attached to the tiltable plate 84 and is operable in response to upward tilting of the plate 84 by a user's head. Such movement closes the switch 88 and thereby activates a suitable display unit 54'. The switch 88 also serves as a counterweight for returning the plate 84** to its non-engaged or at-rest position for reuse.

As seen in FIG. 2, this embodiment also includes a golf swing sensing assembly including an infrared photoresponsive motion detector 50' mounted on the horizontal base 18'. The detector 50' is, preferably, horizontally adjustable to different positions through suitable means (not shown), such as a spring clasp, set screw or the like. The infrared photoresponsive motion detector 50' is aligned with a golf tee (not shown) and golf ball (not shown) so that it will sense impact of a golf club with the ball. Spaced in aligned and juxtaposed relationship to the infrared photoresponsive motion detector 50' is an infrared light transmitter 44' with is situated on the ground so that an emitted infrared beam 46' will strike the ball and a window of the detector 50'. The photoresponsive motion detector 50' is connected to the control circuitry of the display unit 54' in such a manner that upon a golf club striking the golf ball, a signal is generated by the detector 50'. The control circuit of the display unit 54' is constructed, as in the previous embodiment, such that there is activation of audible or visible signals as will be described. So long as there is no sensed motion of the golfer's head by the detector 50' prior to the club contacting the ball a light or buzzer will be activated to indicate a successful or good swing. If head motion, as sensed by the switch 88, occurs prior to the golf club striking the golf ball as sensed by the detector 50', the display unit 54' will suppress activation of the indicator which represents a successful swing and activate a light or other indicator representing a bad swing (i.e. undesired head movement prior to a golf ball being struck). Thus, the display unit 54' allows a user to have his head follow-through in a natural fashion and activate the switch 88 without the activation of a bad or unsuccessful swing light or alarm.

Accordingly, a user will have a real time feedback as to whether or not the head was moved undesirably prior to the golf club striking the golf ball. It will be further appreciated that the user has the benefit of a helmet which provides the desired guidance and allows for head movement for triggering a display unit.

This embodiment is then useful specifically for beginners, since the helmet 80 provides the type of guidance for proper head placement during swinging, but allows natural follow-through of the head during a successful swing.

Certain changes may be made in the above described golf training method and apparatus without departing from the scope of the present invention. It is, therefore, intended that the matter contained in the description above and shown in the accompanying drawings shall be interpreted as illustrative and not in any limiting sense.

What is claimed:

1. A golf training system for detecting unwanted golfer's head displacement during a golf swing, said system comprising:

a support assembly having a vertically adjustable assembly;

first motion detecting means being operable for detecting golfer's head displacement and for generating a signal indicative of such displacement, said first detecting means being an electromagnetic motion detecting means;

second motion detecting means being operable for detecting a golf club head travelling in a preselected zone which zone is inclusive of where a golf ball would be during a swing and for generating a signal indicative of a golf club travelling in said zone and impacting a ball;

means responsive to said signals of said first and second motion detecting means for indicating unwanted golfer's head displacement prior to a golf club head travelling in said zone; and, said indicating means is operable for indicating when a golf club head travels in said zone prior to golfer's head displacement for indicating unwanted golfer's head displacement.

2. The system of claim 1 wherein first motion detecting means is an infrared motion detecting means.

3. The system of claim 1 wherein said infrared motion detecting means includes a first infrared photoresponsive motion detector means attached to said vertically adjustable assembly and being vertically adjustable relative to individual golfer's heads; and a first infrared transmitting means positionable on an upright support spaced laterally from said infrared photo-responsive motion detector means and being operable for transmitting an infrared beam to said first photoresponsive motion detector means so that preselected head displacement will interrupt said infrared beam.

4. The system of claim 3 wherein said second motion detecting means includes a second infrared photoresponsive motion detector means mounted on said support assembly for being horizontally adjustable relative to said support assembly, and a second infrared transmitting means spaced laterally from said second infrared photoresponsive motion detector means and being operable for transmitting an infrared beam to said second infrared photoresponsive means, said second infrared photo-responsive means being operable for generating a signal upon a golf club traveling in said zone.

5. The system of claim 1 further including golfer's head restraining means for guiding a golfer's head into a proper orientation for a golf swing and for permitting limited head displacement at least during the swing; said head restraining means being mounted on said vertically adjustable assembly.

6. The system of claim 5 wherein said head restraining means includes a helmet assembly adapted to accommodate a golfer's head and for guiding the head into said proper orientation and including a portion movable in response to head displacement during a swing.

7. The system of claim 6 wherein said movable portion includes a pivotable member adapted to undergo controlled angular displacement in response to head displacement during a golf swing.

8. The system of claim 7 wherein said support assembly includes a support shaft and said vertically adjustable assembly includes a member adapted to telescopically fit within said vertical support.

9. The system of claim 8 wherein said head restraining means includes a laterally extending tubular member and a movable arm member which is telescopically mounted in said tubular member to allow for lateral adjustment of said head restraining means.

10. The system of claim 9 wherein said helmet assembly includes means which provides a counterweight for returning said movable portion to an initial at rest condition so that is can be repositioned for engagement by a golfer's head during a subsequent swing.

11. A golf training system for detecting unwanted golfer's head displacement during a golf swing, said system comprising:

a support assembly having a vertically adjustable assembly;

first motion detecting means being operable for detecting golfer's head displacement and for generating a signal indicative of such displacement;

second motion detecting means being operable for detecting a golf club head travelling in a preselected zone which zone is inclusive of where a golf ball would be during a swing and for generating a signal indicative of a golf club travelling in said zone and impacting a ball;

means responsive to said signals of said first and second motion detecting means for indicating unwanted golfer's head displacement prior to a golf club head travelling in said zone;

said indicating means is operable for indicating when a golf club head travels in said zone prior to golfer's head displacement for indicating unwanted golfer's head displacement; and, golfer's head restraining means for guiding a golfer's head into a proper orientation for a golf swing and for permitting limited head displacement at least during the swing.

12. The system of claim 11 wherein said head restraining means includes a helmet assembly adapted to accommodate a golfer's head and for guiding the head into said proper orientation and including a portion movable in response to head displacement during a swing.

13. The system of claim 12 wherein said movable portion includes a pivotable member adapted to undergo controlled angular displacement in response to head displacement during a golf swing.

14. The system of claim 13 wherein said helmet assembly includes means which provides a counterweight for returning said movable portion to an initial at rest condition so that is can be repositioned for engagement by a golfer's head during a subsequent swing.

15. The system of claim 11 wherein said first motion detecting switch is a motion detecting switch which senses pivotal movement of said pivotable member.

16. A golf training method of detecting unwanted golfer's head displacement during a golf swing, said method comprising the steps of:

providing a support assembly having a vertically adjustable assembly;

providing first motion detecting means being operable for detecting golfer's head displacement and for generating a signal indicative of such displacement, wherein the first detecting means being an electromagnetic motion detecting means;

providing second motion detecting means being operable for detecting a golf club head travelling in a preselected zone which zone is inclusive of where a golf ball would be during a swing and for generating a signal indicative of a golf club travelling in the zone and impacting a ball; and responding to the signals of the first and second motion detecting means for indicating unwanted golfer's head displacement prior to a golf club head travelling in the zone; and indicating when a golf club head travels in the zone prior to head displacement for indicating unwanted golfer's head displacement.

* * * * *